US007683552B2

(12) United States Patent
Chou

(10) Patent No.: US 7,683,552 B2
(45) Date of Patent: Mar. 23, 2010

(54) CIRCUIT STRUCTURE FOR A LAMP SET

(75) Inventor: Chin-Wen Chou, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 33 days.

(21) Appl. No.: 11/902,158

(22) Filed: Sep. 19, 2007

(65) Prior Publication Data

US 2009/0073699 A1 Mar. 19, 2009

(51) Int. Cl.
*H01J 13/46* (2006.01)

(52) U.S. Cl. ..... 315/32; 315/70; 315/55

(58) Field of Classification Search ..... 315/32, 315/177

See application file for complete search history.

(56) References Cited

U.S. PATENT DOCUMENTS

2002/0011790 A1* 1/2002 Holzer ..... 315/56
2004/0100205 A1* 5/2004 Takahashi et al. ..... 315/248
2006/0113926 A1* 6/2006 Lin ..... 315/291

* cited by examiner

*Primary Examiner*—Douglas W Owens
*Assistant Examiner*—Jianzi Chen
(74) *Attorney, Agent, or Firm*—Muncy, Geissler, Olds & Lowe, PLLC

(57) ABSTRACT

A circuit structure for a lamp set which includes a socket, a lamp assembly mounted onto the socket and an electrode portion. The lamp assembly surrounds a housing space inside to hold a power distribution dock connecting to the socket. The power distribution dock has a holding space to hold a power conversion element which is electrically connected to the electrode portion to receive external electric power and transform to starting power to drive the lamp assembly to generate light. The power distribution dock and the power conversion element are located in the housing space. Thus the total height of the socket is reduced and the lamp set can be shrunk to a smaller size.

16 Claims, 4 Drawing Sheets

CIRCUIT STRUCTURE FOR A LAMP SET

FIELD OF THE INVENTION

The present invention relates to a circuit structure for a lamp set and particularly to a structure for a lamp set equipped with a power conversion means.

BACKGROUND OF THE INVENTION

A conventional fluorescent lamp assembly mainly includes a lamp set and a light bulb assembly. The light bulb assembly includes a shell, a socket and at least one lamp assembly. To install the light bulb assembly on the lamp set further requires a ballast and a starter to provide power to enable the light bulb assembly to function in a stable manner. The conventional fluorescent lamp assembly has the starter and ballast installed separately from the lamp set. The ballast is located at one side of the lamp set in a separated or integrated manner. In order to increase the application scope and operation efficiency, many fluorescent lamp assemblies at present adopt an improved structure to become a power-saving lamp (referring to FIG. 1). The power-saving lamp includes a lamp assembly 1, a socket 2, a shell 3, a connection element 8 and an electrode portion 6. There also is a housing space 4 spared between the socket 2 and shell 3. To improve power utilization efficiency each power-saving lamp has a power conversion element 5 which also provides the functions of the conventional starter and ballast. The power-saving lamp generally can be mounted onto a conductive socket by screwing like a conventional incandescent lamp to receive electric power. The power conversion element 5 transforms the electric power to generate light. The power-saving lamp provides a wider application scope and higher operation efficiency than the conventional fluorescent lamp. But it is more bulky than the conventional incandescent lamp due to housing the power conversion element 5. Lamp producers try to shrink the size of the power conversion element 5 to make the total size of the lamp set smaller. This makes driving multiple lamp sets 1 more difficult. Moreover, shrinking the size also increases energy density of the power conversion element 5, and the element materials of the power conversion element 5 must have a greater heat-resistant capability. All this make design of the power-saving lamp more difficult. As a result the power-saving lamp is more expensive than the general fluorescent lamp or incandescent lamp. There is still room for improvement to address the problems of design difficulty and higher cost mentioned above.

SUMMARY OF THE INVENTION

To improve the shortcomings occurred to the conventional lamp sets the primary object of the present invention is to provide a circuit structure for a power-saving lamp set with an adequate space to enhance heat dissipation and also improve space utilization of the lamp set.

In the circuit structure for a lamp set of the invention, the lamp set includes a socket, an electrode portion connecting to the socket and a lamp assembly mounted onto the socket. The lamp assembly surrounds a housing space inside to hold a power distribution dock connecting to the socket. The power distribution dock has a holding space to hold a power conversion element which is electrically connected to the electrode portion to receive external electric power and transform to starting power to drive the lamp assembly. The power conversion element and the lamp assembly are located at the same side of the socket so that the total height of the socket and the size of the lamp set can be reduced. The housing space located between the socket and the lamp assembly is slightly larger than the space of a conventional lamp set to make the energy density of the power conversion element smaller.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
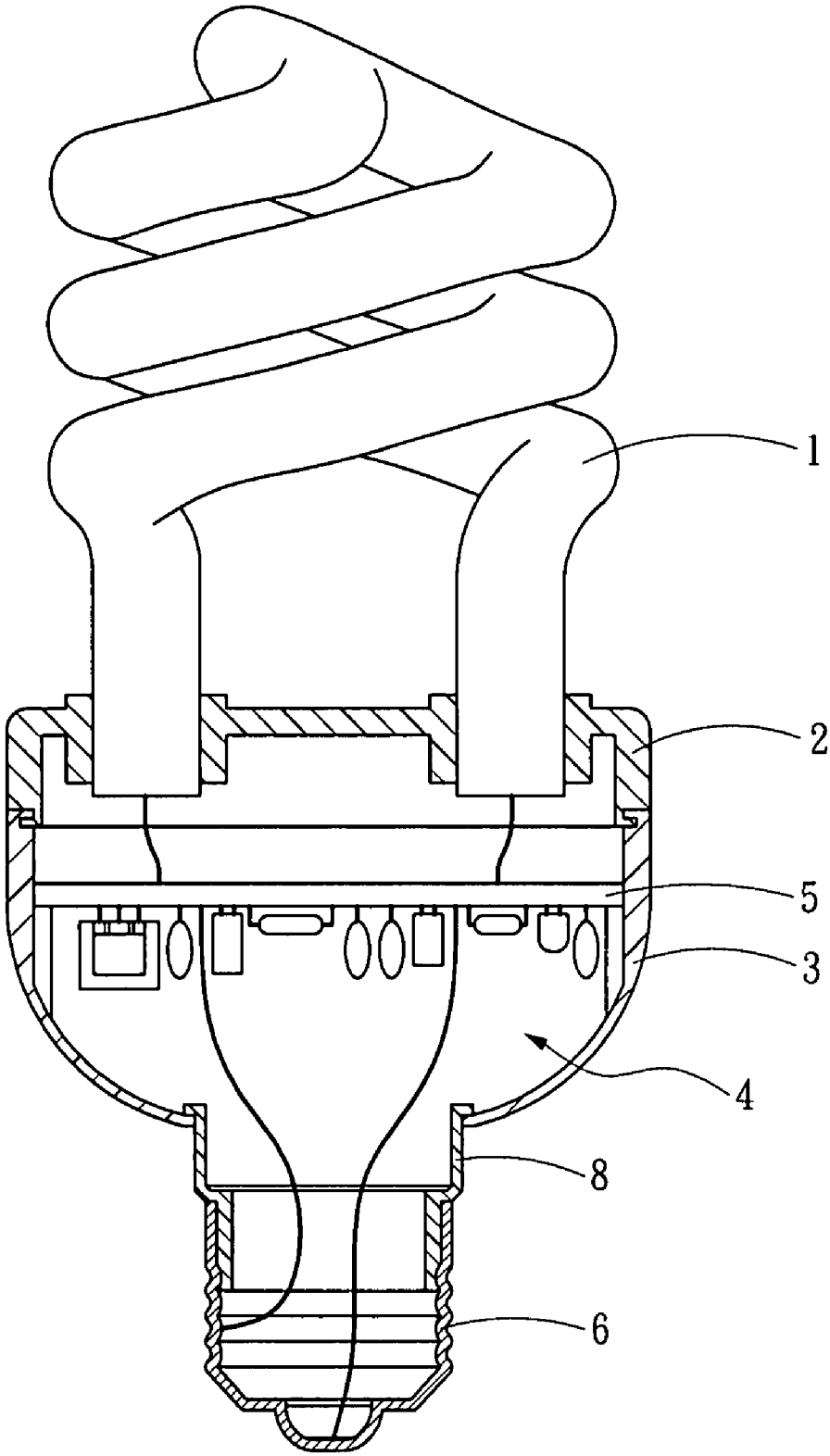
Fig. 1 PRIOR ART
FIG. 1 is a sectional view of a conventional lamp.
Figure 2:
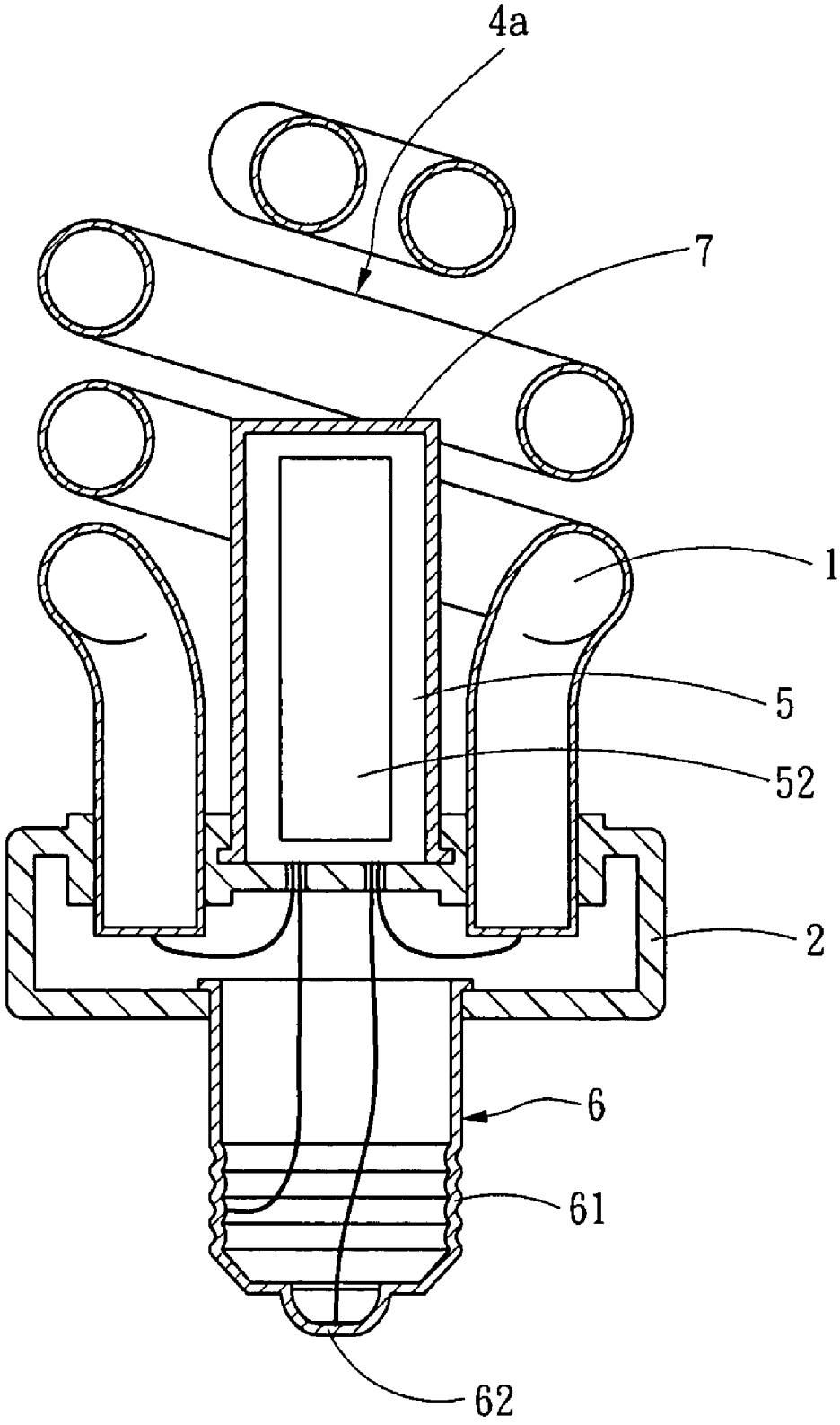
FIG. 2 is a sectional view of an embodiment of the invention.
Figure 3:
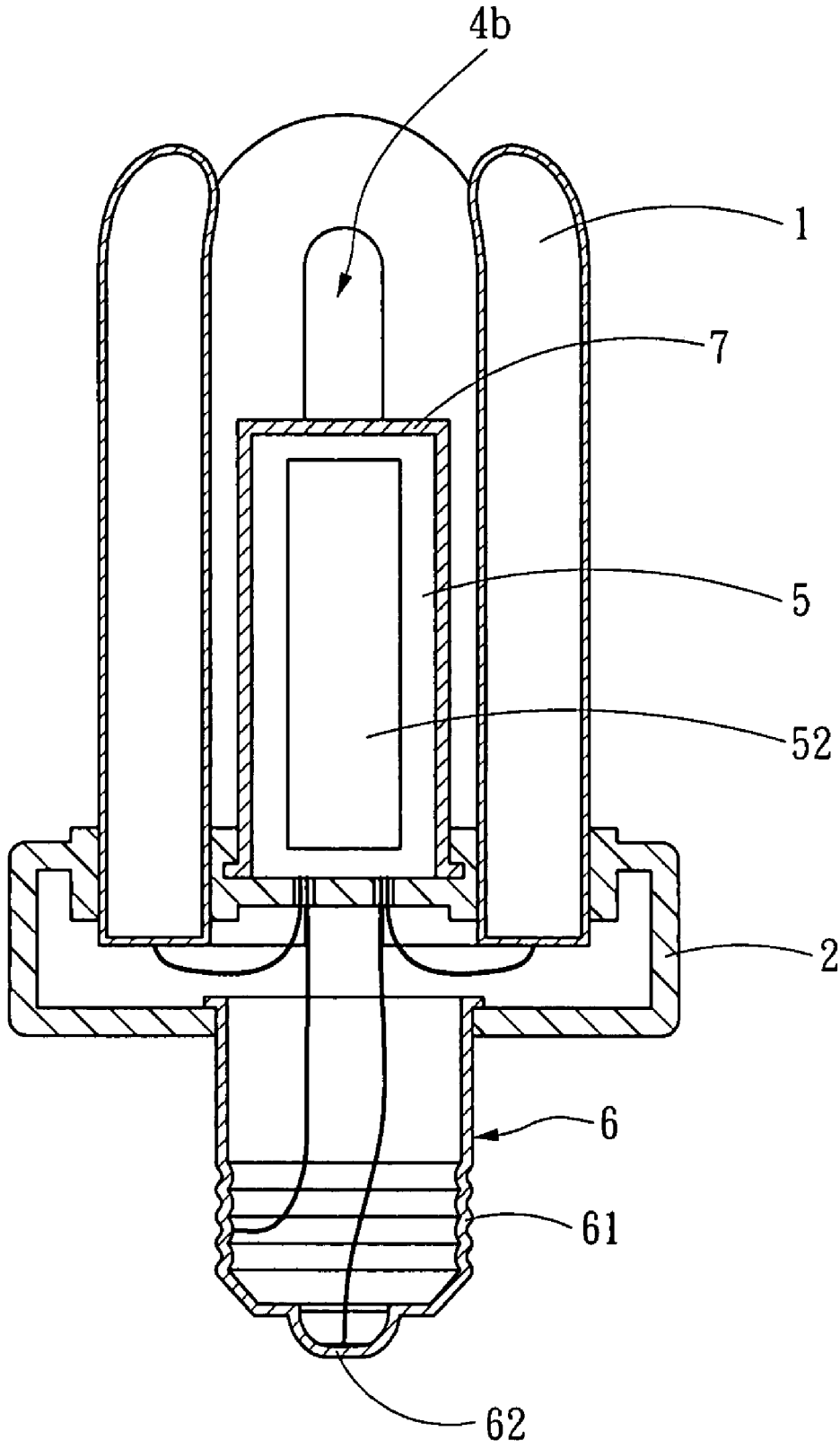
FIG. 3 is a sectional view of another embodiment of the invention.

Please refer to FIG. 2 for a circuit structure for a lamp set of the invention. The lamp set includes a socket 2 and a lamp assembly 1 mounted onto the socket 2. The socket 2 is connected to an electrode portion 6. The lamp assembly 1 surrounds a housing space 4*a* inside to hold a power distribution dock 7 connecting to the socket 2. The power distribution dock 7 contains a power conversion element 5 which has a circuit board with a transformer 52 located thereon. The power conversion element 5 and the electrode portion 6 have respectively a point electrode 62 and a threaded electrode 61 that are electrically connected to receive external electric power and transform to starting power to drive the lamp assembly 1. The power distribution dock 7 holding the power conversion element 5 is located in the housing space 4*a* so that no additional space is needed to be spared at the lower side of the socket 2. Thus the total height of the lamp set can be reduced. The lamp assembly 1 is not limited to a threaded lamp. It may also be an upright lamp cluster or U-shaped lamp cluster (referring to FIG. 3) and held in a housing space 4*b* surrounded by the socket 2.

Figure 4:
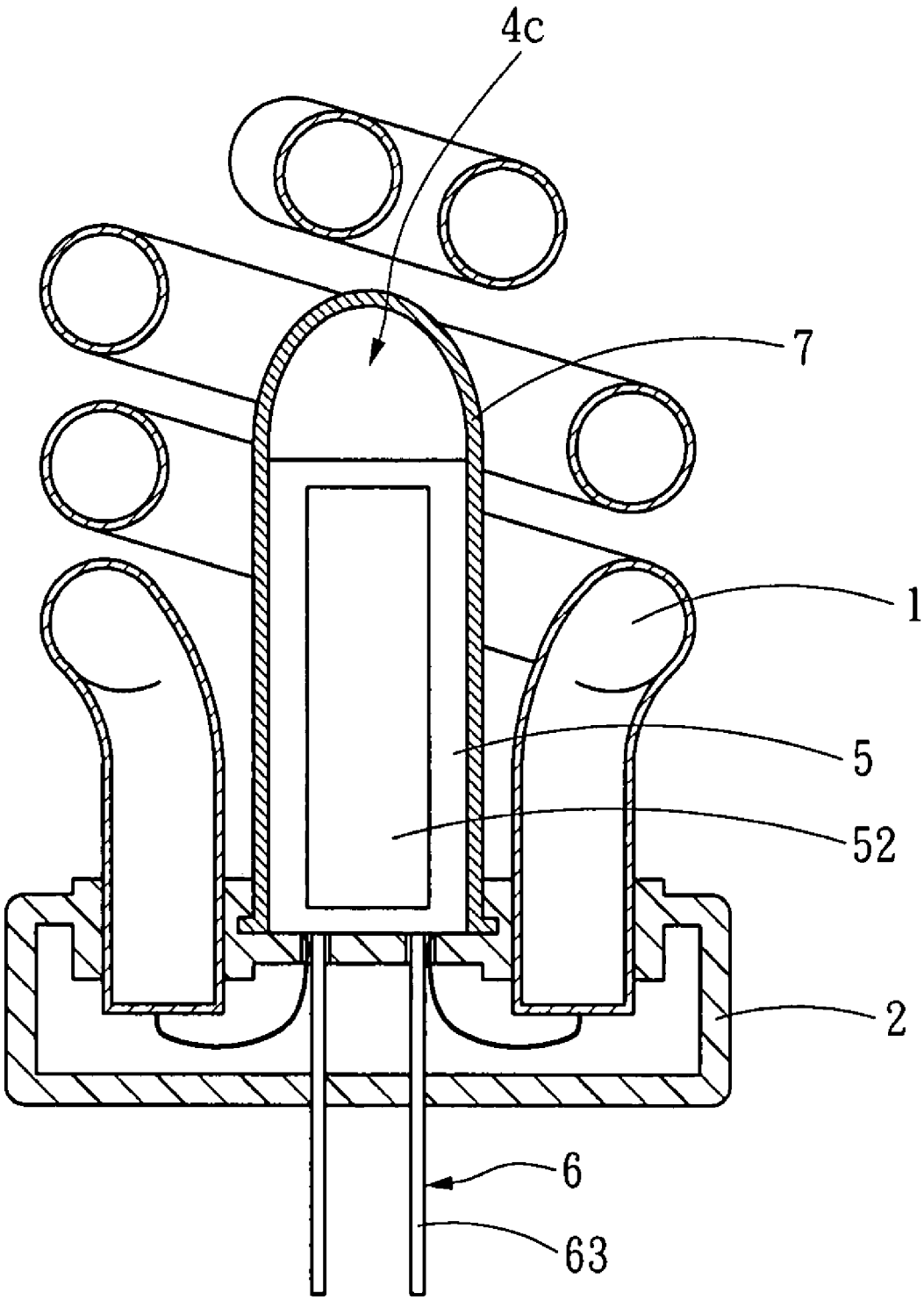
FIG. 4 is a sectional view of yet another embodiment of the invention.

Referring to FIG. 4 for yet another embodiment of the invention. The lamp assembly 1 has a housing space 4*c* to hold the power distribution dock 7 connecting to the socket 2. The power distribution dock 7 holds the power conversion element 5. The power distribution dock 7 may be formed in different shapes according to the size of the housing space 4*c* and connected to the socket 2. The power distribution dock 7 may be formed in a square (referring to FIGS. 2 and 3), cylindrical, conical or cylindrical with a curved distal end (as shown in FIG. 4) so that the power distribution dock 7 can encase and protect the power conversion element 5. The power distribution dock 7 may be coated with a reflective layer on the surface to reflect inward projecting light toward outside. As shown in FIG. 4, the electrode portion 6 has two insertion terminals 63 to connect to a power source. External electric power is transmitted through the insertion terminals 63 to the power conversion element 5 which drives the lamp assembly 1 to generate light. By means of the structures set forth above the power conversion element 5 can be adopted to various types of lamp sets to increase power utilization efficiency at a smaller height and size.

The socket 2 and power distribution dock 7 previously discussed and shown in the drawings are formed by injection in an integrated manner. The transformer 52 may be a piezoelectric transformer or winding transformer. The electrode portion 63 may include two or more insertion terminals 63, and also be changed to other types of conductive structures according to different types of lamp sets.

While the preferred embodiments of the invention have been set forth for the purpose of disclosure, they should not be deemed as the limitation of the invention. Modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A circuit structure for a lamp set which includes a socket, an electrode portion connecting to the socket and a lamp assembly mounted onto the socket, comprising:

a housing space surrounded by the lamp assembly and a power distribution dock located in the housing space connecting to the socket, the power distribution dock having a holding space to hold a power conversion element which is electrically connected to the electrode portion to receive and transform external electric power to starting power to drive the lamp assembly, where the power conversion element is a circuit board having a transformer located thereon, where both the circuit board and the transformer are in the power distribution dock, wherein the power distribution dock is above the sock, so as to reduce a height of the lamp set.

2. The circuit structure for the lamp set of claim 1, wherein the transformer is a piezoelectric transformer.

3. The circuit structure for the lamp set of claim 1, wherein the transformer is a winding transformer.

4. The circuit structure for the lamp set of claim 1, wherein the electrode portion includes a point electrode and a threaded electrode.

5. The circuit structure for the lamp set of claim 1, wherein the electrode portion has two insertion terminals.

6. The circuit structure for the lamp set of claim 1, wherein the electrode portion has more than two insertion terminals.

7. The circuit structure for the lamp set of claim 1, wherein the lamp assembly is a threaded lamp.

8. The circuit structure for the lamp set of claim 1, wherein the lamp assembly is an upright lamp cluster.

9. The circuit structure for the lamp set of claim 1, wherein the lamp assembly is a U-shaped lamp cluster.

10. The circuit structure for the lamp set of claim 1, wherein the power distribution dock is square.

11. The circuit structure for the lamp set of claim 1, wherein the power distribution dock is cylindrical.

12. The circuit structure for the lamp set of claim 1, wherein the power distribution dock is cylindrical and has a curved distal end.

13. The circuit structure for the lamp set of claim 1, wherein the power distribution dock is conical.

14. The circuit structure for the lamp set of claim 1, wherein the power distribution dock and the socket are integrally formed by injection.

15. The circuit structure for the lamp set of claim 1, wherein the power distribution dock has the surface thereof coated with a reflective layer.

16. The circuit structure for the lamp set of claim 1, wherein a height of the socket is reduced by the inclusion of the circuit board and transformer in the power distribution dock.

* * * * *